US005402559A

United States Patent [19]

Allison et al.

[11] Patent Number: 5,402,559

[45] Date of Patent: Apr. 4, 1995

[54] FLOOR SCRUBBER

[76] Inventors: Dale L. Allison, 353 Juedes Ave. N., Salem, Oreg. 97303; George Spector, 233 Broadway Rm 702, New York, N.Y. 10279

[21] Appl. No.: 240,179

[22] Filed: May 3, 1994

[51] Int. Cl.[6] ..... A47L 13/10

[52] U.S. Cl. ..... 15/228; 15/229.11; 15/231; 451/524

[58] Field of Search ..... 15/1.7, 147.2, 159.2, 15/209.1, 210.1, 228, 229.11, 229.13, 231, 246; 51/174, 391–393

[56] References Cited

U.S. PATENT DOCUMENTS

| | | | |
|---|---|---|---|
| 1,045,368 | 11/1912 | Bourne | 15/231 |
| 1,132,511 | 3/1915 | Boughan | 15/246 |
| 1,139,809 | 5/1915 | Schultz | 15/209.1 |
| 1,575,057 | 3/1926 | Johnson | 15/231 |
| 3,295,155 | 1/1967 | Belsky et al. | 15/228 |
| 3,792,505 | 2/1974 | Saltzstein | 15/231 |
| 4,580,307 | 4/1986 | Moss | 15/228 |

FOREIGN PATENT DOCUMENTS

| | | | |
|---|---|---|---|
| 803481 | 10/1936 | France | 15/229.13 |
| 582563 | 8/1933 | Germany | 15/159.1 |
| 114465 | 4/1926 | Switzerland | 15/210.1 |
| 226205 | 6/1943 | Switzerland | 15/159.1 |
| 275068 | 7/1951 | Switzerland | 15/231 |
| 22094 | of 1894 | United Kingdom | 15/159.1 |
| 21271 | of 1906 | United Kingdom | 15/159.1 |
| 1152277 | 5/1969 | United Kingdom | 15/1.7 |

*Primary Examiner*—Mark Spisich

[57] ABSTRACT

A floor scrubber is provided which consists of a rectangular head assembly. A rectangular scrub pad is of a larger area than the head assembly. A structure is for removably mounting the scrub pad to a lower surface of the head assembly, in which two longitudinal edges of the scrub pad are spaced away from two longitudinal sides of the head assembly. A handle has a bottom end attached centrally to a top surface of the head assembly. A person can grip the handle to place the scrub pad onto a floor and to permit the longitudinal edges of the scrub pad to fit under partitions in toilets for cleaning. A pair of weights are also provided. Components are for retaining the weights to the head assembly on opposite sides of the handle. The person gripping the handle does not have to press down hard for the scrub pad to clean the floor.

1 Claim, 1 Drawing Sheet

FLOOR SCRUBBER

BACKGROUND OF THE INVENTION

The instant invention relates generally to floor cleaning tools and more specifically it relates to a floor scrubber, which provides built-in weights to press down on the floor to clean it.

There are available various conventional floor cleaning tools which do not provide the novel improvements of the invention herein disclosed.

SUMMARY OF THE INVENTION

A primary object of the present invention is to provide a floor scrubber that will overcome the shortcomings of the prior art devices.

Another object is to provide a floor scrubber with built-in weights, so that a person using the floor scrubber does not have to press down hard on the floor to clean the floor.

An additional object is to provide a floor scrubber that is so constructed so that it can fit under partition walls in toilets where a buffer machine cannot reach.

A further object is to provide a floor scrubber that is simple and easy to use.

A still further object is to provide a floor scrubber that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
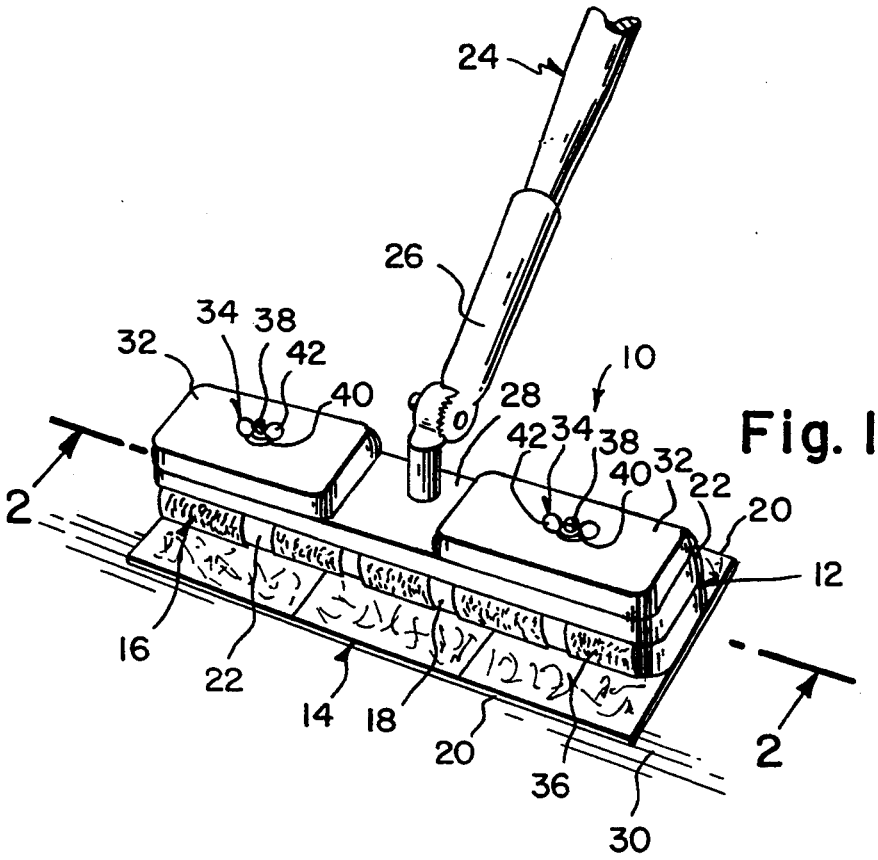
FIG. 1 is a perspective view of the instant invention.
Figure 2:
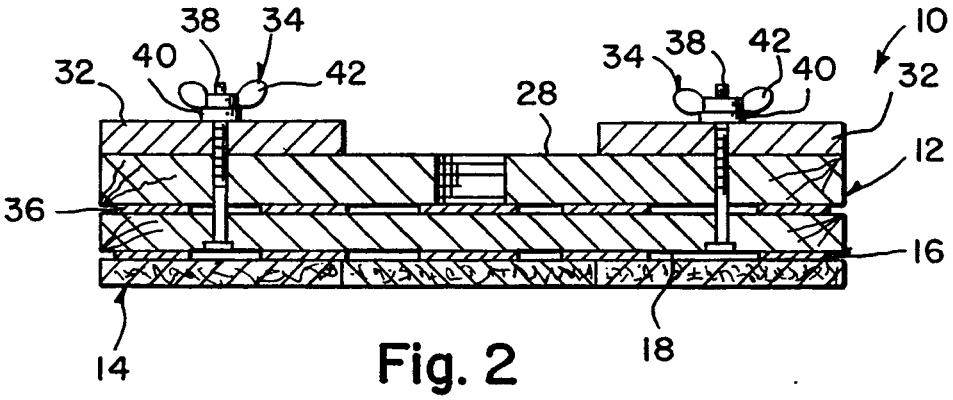
FIG. 2 is a cross sectional view taken along line 2—2 in FIG. 1.

Turning now descriptively to the drawings, in which similar reference characters denote similar elements throughout the several views, FIGS. 1 and 2 illustrate a floor scrubber 10, which consists of a rectangular head assembly 12. A rectangular scrub pad 14 is of a larger area than the head assembly 12. A structure 16 is for removably mounting the scrub pad 14 to a lower surface 18 of the head assembly 12, in which two longitudinal edges 20 of the scrub pad 14 are spaced away from two longitudinal sides 22 of the head assembly 12. A handle 24 has a bottom end 26 attached centrally to a top surface 28 of the head assembly 12. A person can grip the handle 24, to place the scrub pad 14 onto a floor 30 and to permit the longitudinal edges 20 of the scrub pad 14 to fit under partitions in toilets for cleaning. A pair of weights 32 are also provided. Components 34 are for retaining the weights 32 to the head assembly 12 on opposite sides of the handle 24. The person gripping the handle 24 does not have to press down hard for the scrub pad 14 to clean the floor 30.

The removably mounting structure 16 is at least one hook fabric fastener strip 36 affixed to the head assembly 12, so as to engage with the scrub pad 14.

The retaining components 34, as shown in FIGS. 1 and 2 includes a pair of bolts 38, each extending through the lower surface 18 of the head assembly 12 and one weight 32. A pair of washers 40 are each placed onto an upper free end of one bolt 38. A pair of wing nuts 42 are also provided, with each threaded onto the upper free end of one bolt 38.

Figure 3:
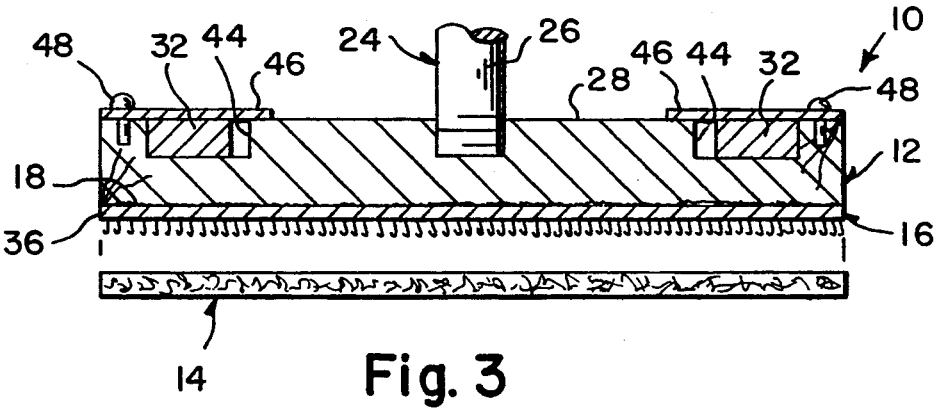
FIG. 3 is a cross sectional view similar to FIG. 2, showing a modification in which one headpiece is utilized with countersunk removable and interchangeable weights applied thereto.

In FIG. 3, the retaining components 34 include the head assembly 12 having a pair of spaced apart recesses 44 in the top surface 28 on opposite side of the handle 24 in which each recess 44 will receive one weight 32. A pair of pivot plates 46, each fit over one recess. A pair of pivot pins 48 are also provided, with each to affix one side of one pivot plate 46 into the top surface 28 of the head assembly 12. Each pivot plate 46 can pivot open to remove and replace each weight 32.

OPERATION OF THE INVENTION

To use the floor scrubber 10 in FIGS. 1 and 2, the person simply attaches the weights 32 to the top surface 28 of the head assembly 12 with the bolts 38, washers 40 and wing nuts 42. The scrub pad 14 is removably mounted to the at least one hook fabric fastener strip 36, in which the longitudinal edges 20 of the scrub pad 14 can fit under the partitions in the toilets.

To use the floor scrubber 10 in FIG. 3, the person simply places the weights 32 into the recesses 44 in the top surface 28 and then closes the pivot plates 46, to retain the weights 32 therein. The scrub pad 14 is removably mounted in the same manner as in FIGS. 1 and 2. The weights 32 can come in various sizes, as long as they fit into the recesses 44.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A floor scrubber which comprises:

a) a rectangular head assembly;

b) a rectangular scrub pad of a larger area than said head assembly;

c) means for removably mounting said scrub pad to a lower surface of said head assembly, in which two longitudinal edges of said scrub pad are spaced away from two longitudinal sides of said head assembly;

d) a handle having a bottom end attached centrally to a top surface of said head assembly, so that a person can grip said handle to place said scrub pad onto a floor and to permit the longitudinal edges of said scrub pad to fit under partitions in toilets for cleaning;

e) a pair of weights;

f) means for retaining said weights to said head assembly on opposite sides of said handle, so that the person gripping said handle does not have to press down hard for said scrub pad to clean the floor; wherein said removably mounting means is at least one hook fabric fastener strip affixed to said head assembly, so as to engage with said scrub pad; wherein said retaining means includes:

g) said head assembly having a pair of spaced apart recesses in the top surface on opposite sides of said handle, in which each said recess will receive a respective one of said weights;

h) a pair of pivot plates, each to fit over a respective one of said recesses and i) a pair of pivot pins, each affixing to one side of a respective one of said pivot plates onto the top surface of said head assembly, so that each said pivot plate can pivot open to remove and replace each said weight.

* * * * *